United States Patent [19]

Gregory

[11] Patent Number: 4,695,203

[45] Date of Patent: Sep. 22, 1987

[54] METHOD AND APPARATUS FOR SHORING AND SUPPORTING A BUILDING FOUNDATION

[75] Inventor: Steven D. Gregory, Ada, Okla.

[73] Assignee: Gregory Enterprises, Inc., Ada, Okla.

[21] Appl. No.: 722,060

[22] Filed: Apr. 11, 1985

[51] Int. Cl.[4] ..... E02D 5/00

[52] U.S. Cl. ..... 405/230; 254/29 R

[58] Field of Search ..... 405/229-231, 405/251, 253; 254/29 R; 52/125.1, 126.1, 126.3

[56] References Cited

U.S. PATENT DOCUMENTS

| | | | |
|---|---|---|---|
| 2,322,855 | 6/1943 | Lenehan | 405/230 |
| 3,796,055 | 3/1974 | Mahony . | |
| 3,852,970 | 12/1974 | Cassidy . | |
| 3,861,156 | 1/1975 | Uchida | 254/29 R X |
| 3,902,326 | 9/1975 | Langenbach . | |

*Primary Examiner*—Dennis L. Taylor

*Assistant Examiner*—Nancy J. Stodola

*Attorney, Agent, or Firm*—Warren B. Kice

[57] ABSTRACT

An improved method and apparatus for supporting and shoring building foundations and walls in which one or more pilings are disposed at a point outside the perimeter of a structure. The pilings are driven into the supporting strata to a point determined by said strata's resistance to a predetermined amount of driving force. The pilings thus disposed provide a foundation for the subsequent attachment and securing of the apparatus of the present invention which functions to raise and support the foundation or wall to a predetermined level. The apparatus of the present invention includes a lifting arm for engaging the foundation, a sleeve portion for guiding the pilings, a removably secured lifting saddle, and a hydraulically operated jack for applying a force between the saddle and the pilings to raise the foundation a predetermined distance.

11 Claims, 2 Drawing Figures

METHOD AND APPARATUS FOR SHORING AND SUPPORTING A BUILDING FOUNDATION

BACKGROUND OF THE INVENTION

This invention relates to a method and apparatus for supporting and shoring building foundations and more particularly to a simple and efficient means for raising and supporting structural walls that have recessed due to shifting and/or weak supporting strata.

A variety of methods and means have been disclosed for raising and securing the large weights associated with structural walls and foundations. U.S. Pat. No. 3,902,326 to Langenbach, for example, teaches the attachment of a bracket means to a building foundation for use in conjunction with piling means wherein the weight of the building to be shored defines the limits of the driving force used to position supporting piling. Additionally, U.S. Pat. No. 3,852,970, while teaching a more elaborate system of pile disposition and coordinated lifting means, again relies upon the attachment of a bracket plate to the wall or foundation for use in a system of piling support utilizing the building weight as a counteracting force to define the necessary shoring force. U.S. Pat. No. 3,796,055 teaches the disposition of a piling in conjunction with a concret jacking pad which provides foundation support for a jacking means. Such devices, in addition to lacking flexibility, have the added disadvantage of being unable to insure that the piling foundation will provide sufficient support for the structure.

The device of the present invention overcomes many of the disadvantages associated with the above devices by providing a simple, efficient and flexible apparatus and method of lifting and supporting sinking foundations wherein an external ram is utilized permitting the driving of support pilings prior to attachment to the foundation.

SUMMARY OF THE INVENTION

It is therefore an object of the present invention to provide one or more lifting arms that are provided with a horizontal and vertical surface. Said arms are further provided with a sleeve member which is permanently secured to the vertical portion of the lifting arm. After excavation to a point that exposes the grade beam of the structure to be supported, said arms are loosely fitted under said beam in such a manner as to position the sleeve portion in a vertical position more or less parallel to the wall to be supported. One or a series of pilings provided with longitudinal slots are loosely disposed through said sleeve portion(s) of the lifting arm(s). An external, pneumatic, hydraulic, or mechanical driving means, which is capable of providing a specified number of foot pounds of energy is disposed above said pilings. The pilings are further provided with a connecting means that permits extending the pilings as necessary. After driving said pilings to the point of predetermined resistance, a lifting saddle is provided which can be secured to the lifting arm. A jacking pad is then placed within the upper end of the last piling member and a hydraulic jack is then placed upon said pad so that when the hydraulic operated piston is extended, it will engage the lifting saddle and begin raising the structure. Upon realization of the desired height, the lifting arm is welded to the piling(s).

DESCRIPTION OF THE PREFERRED EMBODIMENT

Figure 1:
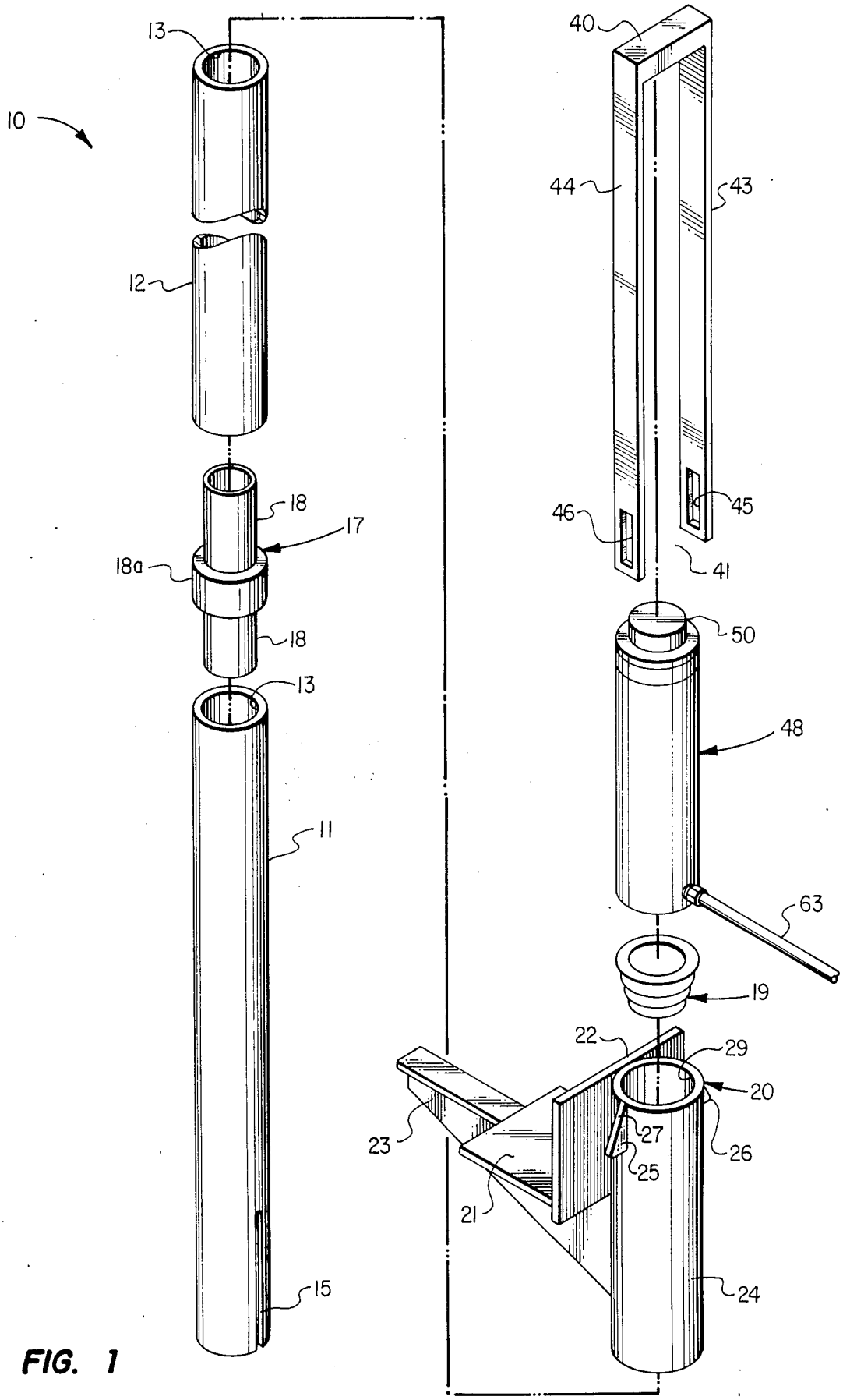
FIG. 1 is an exploded view of the improved apparatus for shoring and supporting building foundations showing its component parts.

As can be seen by referring to FIG. 1, the present improved apparatus for shoring and supporting a building foundation is designated generally by the reference numeral 10 and is comprised of a base piling member 11 and at least one extension piling member 12. Both piling members 11 and 12 are constructed of seamless steel which has a high tensile strength and of an alloy which resists soil corrosion, and are of a tubular configuration with a hollow portion 13 running the length of the piling. The base piling member 11 may contain two or more elongated slots 15 which are disposed along the vertical length of the piling 11 a distance of approximately twelve inches from the bottom of said piling. These elongated slots 15 serve to enhance the piling's ability to support the foundation in cases where there is no reasonably shallow bedrock, since the slots permit the base piling member to spread as the piling is being driven.

The extension piling member 12 is connected to the base piling member 11 and to any additional extension piling members by means of a piling connector 17 which consists of an elongated metallic rod 18 with a diameter suitable for insertion into the hollow portions 13 of the piling members. The rod 18 may be further provided with an enlarged diameter 18*a* at a point equidistant from the ends of the rod 18, said enlarged diameter being of a diameter equal to the outer circumference of said piling members 11 and 12. The piling extension member 12, with connector 17 welded in place, is connected to the piling member 11 by inserting the rod 18 into the hollow portion 13 of the piling member 11.

A metallic jacking pad 19, of an essentially conical configuration, extends within the upper opening of the upper extneion piling member 12.

A lifting arm assembly 20 extends over the extension piling member 12 and includes a horizontal plate 21 and a vertical plate 22 extending at an angle of approximately 90 degrees to each other. The assembly 20 is constructed of steel or other suitable material and is provided with a support arm 23 disposed beneath the horizontal plate 21. The arm assembly 20 also includes a sleeve member 24 of a tubular configuration and having an internal diameter 29 sized to easily accommodate the piling members 11 and 12. The sleeve member 24 is disposed vertically along the outer surface of the vertical plate 22 and may be welded to the plate 22 or may be part of a single cast mold. The sleeve member 24 is further provided with metallic protrusions 25 and 26 on either side of said member which are of a perpendicular triangular configuration disposed so that the apex 27 of each triangle faces upwardly along the vertical axis of said sleeve member 24.

A metallic lifting saddle 40 extends over the arm assembly 20 and is of an elongated, open ended, generally rectangular, configuration. The vertical legs 43 and 44 of the saddle 40 are provided with rectangular slots 45 and 46, respectively, which are of such a dimension as to permit them to receive the metallic protrusions 25 and 26 of the sleeve member 24 upon disposition of the saddle 40 upon the sleeve member 24.

A hydraulic jack 48 is provided between the upper end of the pad 19 and the inside horizontal surface of the saddle 40. The jack 48 includes a piston 50 that is extendible upon the application of a hydraulic fluid to the jack, in a conventional manner.

Figure 2:
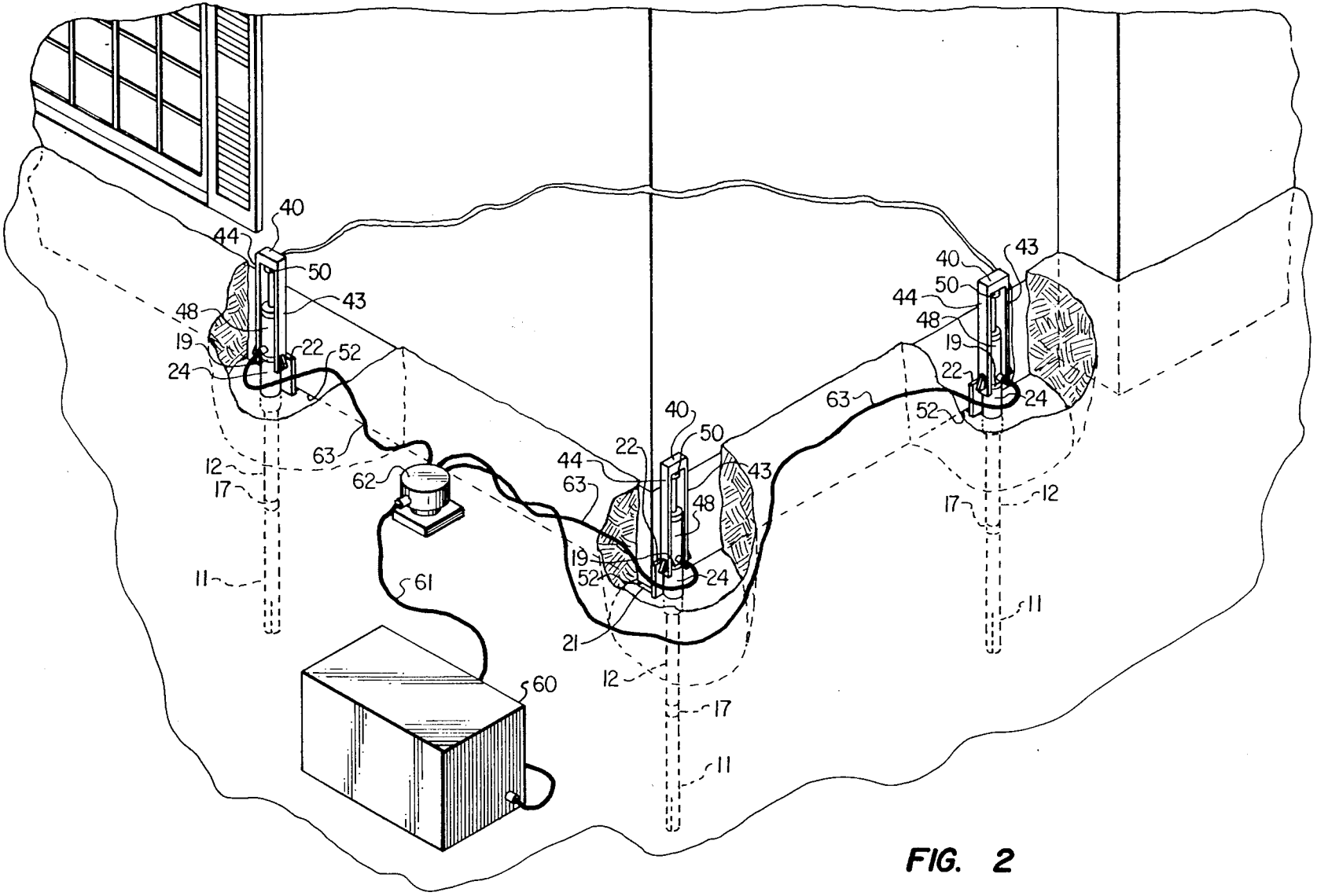
FIG. 2 is a perspective view of the improved apparatus of FIG. 1 showing its disposition in and around a damaged structure.

FIG. 2 shows three apparatus 10 in position relative to a house to be lifted. Before installing the apparatus 10, a series of small excavations are made at points around the outside perimeter of the structure at a depth sufficient to reach the underside of a grade beam 52. The lifting arm assembly 20 of each apparatus 10 is disposed under the beam 52 so that the surrounding soil keeps it in position during the driving of the pilings. The arm assembly 20 is positioned so that the horizontal plate 21 and the vertical plate 22 contact the respective horizontal and vertical surfaces of the grade beam 52.

The base piling member 11 is inserted through the sleeve member 24 of the lifting arm assembly 20 and allowed to come to rest at the bottom of the excavation. A pneumatic, hydraulic or mechanical means (not shown) may then be suspended over the piling member 11 and used to drive it into the ground. After the piling member 11 has been driven to a point where approximately six inches of said piling remain extended beyond the upper edge of the sleeve member 24, an extension piling member 12 with connector 17 welded in place is disposed atop the piling member 11. The process is repeated until the base piling member 11 is driven through any partially resistive material to refusal which is usually bedrock or its equivalent. In its present embodiment that point is determined to be the point beyond which 350,000 ft. pounds per min. of driving force will no longer drive the column of pilings, though the process permits an adjustment of the acceptable point of resistance depending upon structural requirements.

Once the desired resistance is reached, the lifting saddle 40 is attached to the lifting arm 20 by positioning the vertical extensions 43 and 44 on either side of the sleeve member 24 at a point above the metallic protrusions 25 and 26. A downward force on the saddle 40 forces the extensions 43 and 44 apart and permits engagement of the protrusions 25 and 26 through the rectangular slots 45 and 46. Once the lifting saddle 40 is in position and engaged with the sleeve member 24, the tapered end of the jacking pad 19 is disposed within the upper end of the top extension piling member 12. The hydraulic jack 48 is placed upon the jacking pad 19 and positioned so that its hydraulically operated piston 50 engages the upper inside horizontal surface of the lifting saddle 40.

A hydraulic power unit 60 is then utilized to supply hydraulic pressure through flexible line 61 to a multiport manifold 62. From said manifold 62 hydraulic fluid is simultaneously directed to the three jacks 48 through additional lines 63, all of which are connected by quick connects.

As pressure is applied to the hydraulic jacks 48, their respective pistons 50 extend to the upper inside horizontal surface of their lifting saddles 40. The jacks 48 are thus operated simultaneously so that when pressure is applied, the entire portion of the foundation including the grade beam 52 and the wall of the house will be elevated at one time. Since the base piling member 11 of each system has already been stabilized on bedrock or its equivalent, all the forces applied to the hydraulic jacks 48 are, in turn, transmitted to the lifting arm assembly 20 which thus simultaneously exert an upward lifting force on the grade beam 52, the foundation, and the wall. Once the wall has been restored to its original elevation, the upper end of the sleeve 24 of each assembly 10 is spot welded to the extension piling member 12. The hydraulic pressure is then released and the saddle 40 and the jack 48 of each assembly are removed, whereupon the entire upper surface of the lifting arm sleeve member 24 of each assembly is welded to its corresponding piling member 12.

I claim:

1. An apparatus for raising and supporting the foundation or slab of a building, said apparatus comprising means for engaging the lower surface of said foundation or slab, said engaging means including a tubular guide means; a pipe assembly extending through said guide means and having an upper portion extending above said guide means and a lower portion extending into the ground; a lifting saddle connected to said engaging means and extending around said upper portion of said pipe assembly; hydraulic lifting means extending between said upper portion of said pipe assembly and said lifting saddle, said hydraulic lifting means including a piston disposed coaxially with said pipe assembly, and means for actuating said hydraulic lifting means to extend said piston, said lifting saddle being quick-detachably mounted to said engaging means so that it may be removed therefrom after said foundation or slab is raised.

2. The apparatus of claim 1 where said engaging means further comprises a mounting plate extending to either side of said guide means and adapted to extend in corresponding slots formed in said lifting saddle.

3. The apparatus of claim 1 wherein said engaging means further comprising at least one lifting arm extending outwardly from said guide means for extending underneath and engaging the lower surface of said foundation or slab.

4. The apparatus of claim 1 further comprising a jacking pad extending between the upper end of said pipe assembly and said hydraulic lifting means.

5. The apparatus of claim 4 wherein said jacking pad is of a conical configuration having a series of increasing concentric diameters.

6. The apparatus of claim 1 wherein said lifting saddle is of an elongated open rectangular configuration.

7. A method for raising and supporting the foundation or slab of a building, said method comprising the steps of driving a pipe assembly into the ground until a predetermined resistance is encountered, engaging the lower surface of said foundation or slab with a lifting arm apparatus, guiding said pipe assembly through said lifting arm apparatus, connecting a lifting saddle to said lifting arm apparatus, applying a hydraulic force between said lifting saddle and said pipe assembly to raise said foundation or slab a predetermined distance, and then welding said pipe assembly to said lifting arm apparatus to secure said foundation or slab in said raised position.

8. The method of claim 7 wherein said step of applying comprises the step of placing a hydraulic jack between said pipe assembly and said lifting saddle in a manner so that the piston of said jack extends coaxially with said pipe assembly.

9. The method of claim 8 wherein said piston of said hydraulic jack is expanded to apply said hydraulic force.

10. The method of claim 8 further comprising the step of removing said hydraulic jack and said lifting saddle from said lifting arm apparatus and said pipe assembly after said step of welding.

11. The method of claim 8 further comprising the step of installing a jacking pad between said pipe assembly and said hydraulic jack.

* * * * *